US009169041B2

(12) United States Patent
Thom et al.

(10) Patent No.: US 9,169,041 B2
(45) Date of Patent: Oct. 27, 2015

(54) HELICALLY STACKABLE CONTAINER

(71) Applicant: MacNeil IP LLC, Bollingbrook, IL (US)

(72) Inventors: Allan R. Thom, Clarendon Hills, IL (US); Frederick W. Masanek, Jr., Barrington, IL (US)

(73) Assignee: MacNeil IP LLC, Bolingbrook, IL (US)

( * ) Notice: Subject to any disclaimer, the term of this patent is extended or adjusted under 35 U.S.C. 154(b) by 21 days.

(21) Appl. No.: 13/790,766

(22) Filed: Mar. 8, 2013

(65) Prior Publication Data

US 2014/0251855 A1 Sep. 11, 2014

(51) Int. Cl.
*B65D 1/30* (2006.01)
*B65D 21/02* (2006.01)

(52) U.S. Cl.
CPC ..... *B65D 21/0223* (2013.01)

(58) Field of Classification Search
CPC ..... B65D 1/30; B65D 21/02; B65D 21/0217; B65D 21/022; B65D 21/0231; B65D 21/0223
USPC ..... 206/507–509; 215/10; 220/23.2, 23.83, 220/23.6, 380
See application file for complete search history.

(56) References Cited

U.S. PATENT DOCUMENTS

| | | | | |
|---|---|---|---|---|
| D21,168 | S | 11/1891 | Tenney | |
| D90,868 | S | 10/1933 | Cady | |
| 2,496,093 | A * | 1/1950 | Iwata | 215/10 |
| 2,852,157 | A | 9/1958 | Frater | |
| 3,070,257 | A * | 12/1962 | Bojanowski | 206/508 |
| 4,057,946 | A * | 11/1977 | Barrett | 52/436 |
| 4,802,577 | A | 2/1989 | O'Leary | |
| 4,919,268 | A | 4/1990 | Young et al. | |
| D330,327 | S * | 10/1992 | Messer | D9/500 |
| 5,409,128 | A | 4/1995 | Mitchell | |
| D358,768 | S | 5/1995 | Berggren | |
| D360,336 | S | 7/1995 | Bitel, Jr. | |
| 5,699,925 | A | 12/1997 | Petruzzi | |
| 5,927,499 | A * | 7/1999 | Vesborg | 206/509 |
| D423,935 | S * | 5/2000 | Frazer | D9/520 |
| D428,341 | S * | 7/2000 | Boutin | D9/520 |
| 6,293,422 | B1 | 9/2001 | Jentzsch et al. | |
| 7,740,138 | B2 | 6/2010 | Becklin | |
| 2006/0219593 | A1 * | 10/2006 | Linz | 206/509 |
| 2007/0090076 | A1 * | 4/2007 | Hsia | 215/6 |
| 2007/0138045 | A1 * | 6/2007 | Miller | 206/508 |
| 2010/0326001 | A1 | 12/2010 | Herron | |
| 2012/0118848 | A1 | 5/2012 | Hendrickson et al. | |
| 2012/0279960 | A1 * | 11/2012 | Herndon et al. | 220/23.6 |
| 2013/0240401 | A1 * | 9/2013 | Hall | 206/509 |

OTHER PUBLICATIONS www.tie-ups.it, pages downloaded on Mar. 18, 2013.

(Continued)

*Primary Examiner* — Sue A Weaver
(74) *Attorney, Agent, or Firm* — Perkins IP Law Group LLC; Jefferson Perkins

(57) ABSTRACT

Mating engagement surfaces on the bottom panel and lid on each of two or more containers permit the containers to be helically stacked on an axis. As stacked, a front face of one container is displaced from front faces of adjacent ones of the containers by a predetermined angle preselected to be more than zero but less than ninety degrees.

11 Claims, 9 Drawing Sheets

(56) References Cited

OTHER PUBLICATIONS

USPTO As International Searching Authority, International Search Report and Written Opinion of the International Searching Authority issued in connection with Patent Application No. PCT/US2014/019338 on Jun. 17, 2014.

* cited by examiner

HELICALLY STACKABLE CONTAINER

BACKGROUND OF THE INVENTION

Products are often packaged in containers for retail sale; the variety of containers is as varied as the products sold. The packages or containers serve many purposes such as visually attracting consumers, displaying the product, keeping the product clean, keeping pieces together, and preventing theft. Containers are especially useful if the product has an odd or irregular shape or configuration as placing the product in a container makes it easier to stack and/or display the product. Multiple related products may be packaged together in one container for retail sale.

In a retail environment conventional containers may be stacked on display shelves, stacked on a floor or platform, at end caps or special displays, or hung on display racks. Stacking containers for display purposes has inherent problems—stores have limited display space and containers may not be visible to the consumer if placed on high or low shelves. In many instances in an effort to maximize display space, containers are stacked in tall stacks which tend to be unstable. Even if the stacks are stable, there is a high probability one or more of the containers will fall when consumers manipulate containers in tall stacks. The alternative is to keep the stacks low and relatively stable, however, low stacks of conventional containers will not attract consumer attention.

Thus a need exists for a container that maximizes the use of limited retail display space while presenting an attractive, eye-catching, and stable stack.

SUMMARY OF THE INVENTION

According to one aspect of the invention, a container is provided which may be used to create a helical stack of like containers. An engagement surface, such as a star formed out of upwardly extending raised ribs, is defined on the exterior of a top panel of the container. A second, cooperating engagement surface, such as a plurality of raised rib "V's" disposed in a circular pattern, is defined on a bottom panel of the container. When a second container, similar to the first container, is placed on the first container, the cooperation of the first and second engagement surfaces prevent rotational movement between the containers. Additionally, the engagement surfaces are defined such that the second container may be placed on the first container with an angular offset around the axis that is preselected to be greater than zero degrees and less than ninety degrees.

According to another aspect of the invention the containers can be stacked in a helical stack. A first container is placed on, e.g., a display surface. A second container is placed on a first container at a predetermined angle around the axis to the first container, such as an angle of 14.4 degrees. A third container is placed on the second container, where the third container is displaced from the second container by the same predetermined angle. A fourth container may be placed on the third container with a further angular offset of the predetermined angle. The stacking continues until the desired stack height is achieved.

According to yet another aspect of the invention, the engagement surfaces of a plurality of containers may be positioned on the respective panels such that when two of the containers are stacked, the front panel of the first container necessarily is at an angle around the axis relative to the front panel of the second container. The angle of displacement around the axis is between zero and ninety degrees. This forces helical stacking of the containers, if there is only one predetermined position for the cooperating engagement surfaces.

According to another aspect of the invention, a plurality of recesses are disposed on an engagement surface of the first container. A plurality of protuberances are disposed on the cooperating engagement surface of a second container. The protuberances and recesses cooperate in at least one position where, when the containers are stacked, the containers would be angularly displaced from each other.

The present invention provides an advantage to stacking containers in that the helical stack created is stable and eye-catching. The helical stack also saves horizontal floor and display space in the retail environment because the helical stack may be stacked to greater heights than prior art unstable stacks.

The helical stack has the advantage of displaying various aspects of the product to the consumer if a transparent container is used. The helical stack also allows for the viewing of all of the vertical sides of the container which may be printed with labeling, advertising and other information. If there are multiple products in one container, the gradual helical rotation provides the consumer the opportunity to view all of the products packaged in the container without having to take a container off of the stack. As an added advantage, the engagement surfaces on the container panels may be tailored to reflect the product inside the container or applicable marketing campaigns.

BRIEF DESCRIPTION OF THE DRAWINGS

Further aspects of the invention and their advantages can be discerned in the following detailed description, in which like characters denote like parts and in which.

DETAILED DESCRIPTION

The present invention provides a container for use in creating a display stack. In the illustrated embodiment shown in FIG. 1, a container indicated generally at 100 includes a container body 104 and in this embodiment, a top panel thereof which is formed by a lid 102. The lid 102 fits on the container body 104 and is completely removable from the body 104 of the container. The container 100 is preferably formed from a transparent polycarbonate material but may also be formed from transparent rubber, plastic or glass. The container 100 may also be formed from an opaque material, including an opaque polymer, cellulose, metal, ceramic or wood.

Figure 1:
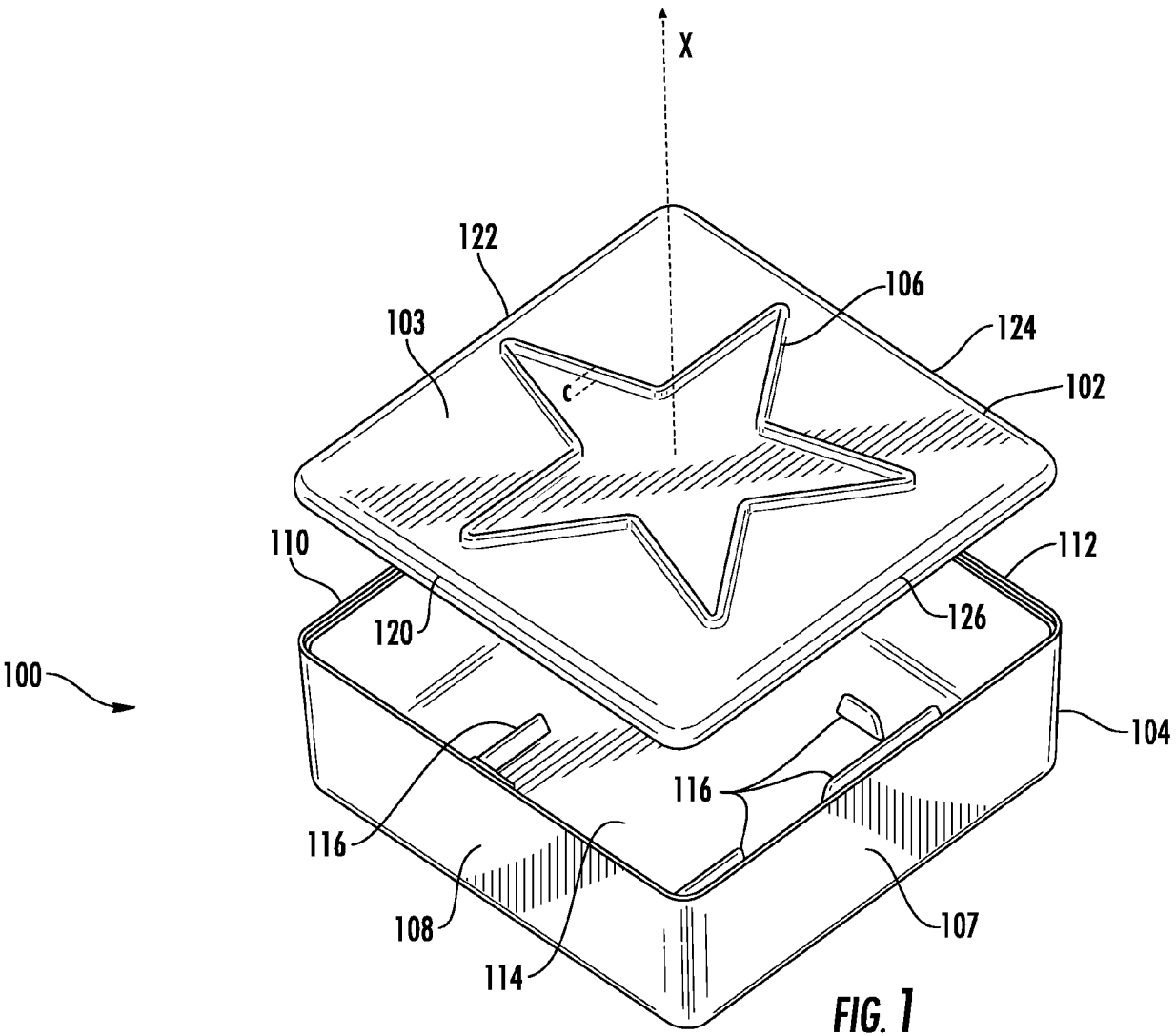
FIG. 1 is an exploded isometric view of a container and lid according to the invention, as seen from above.

As shown in FIG. 1, the lid 102 of the container fits on the container body 104 and is disposed around an axis X. In the illustrated embodiment, the edges of the lid 102 are rounded. The lid 102 has a top panel 103 with a general exterior surface that is substantially perpendicular to the axis X. In the illustrated embodiment, the margins of the top panel 103 curve downwardly to transition to side panels 120, 122, 124 and 126 which are continuous with the side panels of the container body 104 (described below) when the lid 102 is assembled to the rest of the body 104.

According to one aspect of the invention, an engagement surface in the form of a raised-wall star 106 is disposed on the exterior of the top panel 103. This engagement surface cooperates with a second engagement surface (described below) disposed on a second container to prevent rotation around axis X between the two containers and to allow for the second container to be positioned on top of the first container with an angular offset around the axis X that measures more than zero and less than ninety degrees. In the illustrated embodiment, the star 106 consists of raised ribs, upwardly extending from the general horizontal planar surface of the top panel 103. The center of the star 106 is on axis X and corresponds to the center of the top panel 103.

The lower part of the container body 104 has a front panel 107, three side panels 108, 110, 112, and one bottom panel 114. The container body 104 is disposed around axis X. The bottom panel 114, which is square in the illustrated embodiment, has a general exterior surface 212 which is substantially perpendicular to the axis X. As shown in FIG. 1, the shape of the top panel 103 in the illustrated embodiment is substantially identical to the shape of the bottom panel 114. In this illustrated embodiment, panels 107, 108, 110 and 112 are parallel to and spaced from axis X, and form a prism. Side panels 107, 108, 110, 112 may be varied in cross-sectional shape or number; for example, side panels 107, 108, 110 and 112 could be replaced by an elliptical cylinder or a cylinder of irregular cross-section. Nor do the side panels 107, 108, 110, 112 have to be cylindrical or prismatic, so long as they axially space the top panel 103 from the bottom panel 114.

As seen on the embodiment illustrated in FIG. 1, raised fins 116 are situated on and upwardly project from the bottom panel 114 in the interior of the container. The raised fins 116 may be used to keep the product in place in the container and can be integrally formed with the rest of the container body 104.

Figure 2:
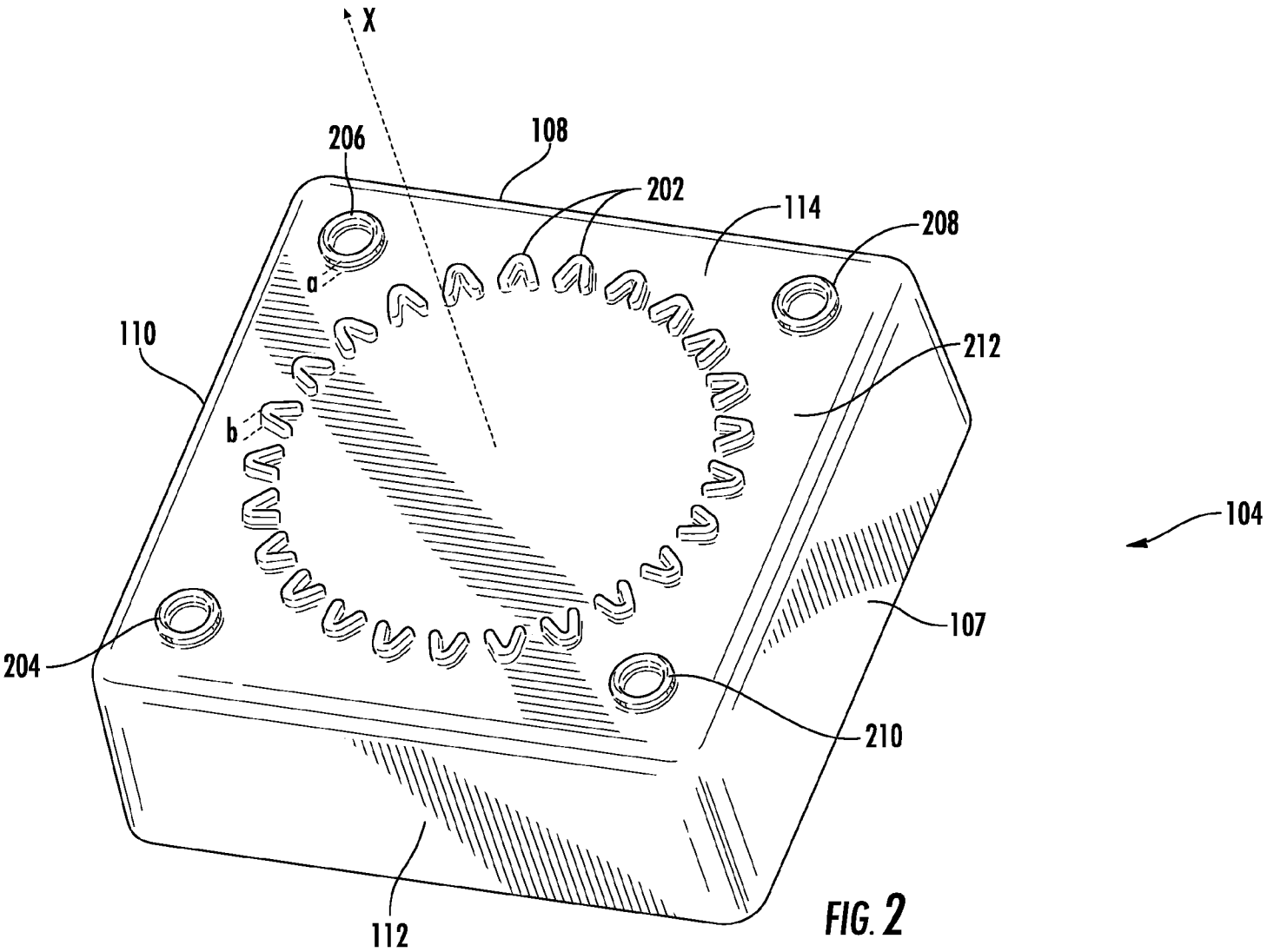
FIG. 2 is an isometric view of the bottom of the container.

An isometric view of the bottom of the container body 104 is shown in FIG. 2. There can be seen twenty-five engagement members 202 downwardly depending from the general horizontal exterior surface 212 of the bottom panel 114 (they extend upwardly in the bottom view). According to one aspect of the invention, each engagement member 202 is a raised rib in the shape of "V" or alternatively a delta. The engagement members 202 are disposed in a circular pattern, the center of which is the geometric center of the bottom panel 114.

The twenty-five engagement members 202 shown in FIG. 2 form an engagement surface on the general exterior surface 212 of the bottom panel 114. The engagement surface on the bottom panel 114 cooperates with a second engagement surface disposed on the top panel 103 of a second container 100 to prevent circular rotation between the two containers and to allow for the second container 100 to be positioned on top of the first container 100 with an angular offset around the axis X that measures more than zero and less than ninety degrees.

As shown in FIG. 2 the bottom panel 114 may have other raised rib walls downwardly depending from the general exterior surface 212 of the bottom panel, such as the container feet 204, 206, 208, 210. The container feet 204, 206, 208, 210 are disposed to be radially spaced from the engagement members 202 and are spaced from each other. The height of the container feet 204, 206, 208, 210 as measured from the general exterior surface 212 of the bottom panel 114 is preferably greater than the height of either of the engagement surfaces. In this illustrated embodiment, the container feet 204, 206, 208, 210 do not cooperate with a first or second engagement surface and are not, therefore, engagement members.

Figure 3:
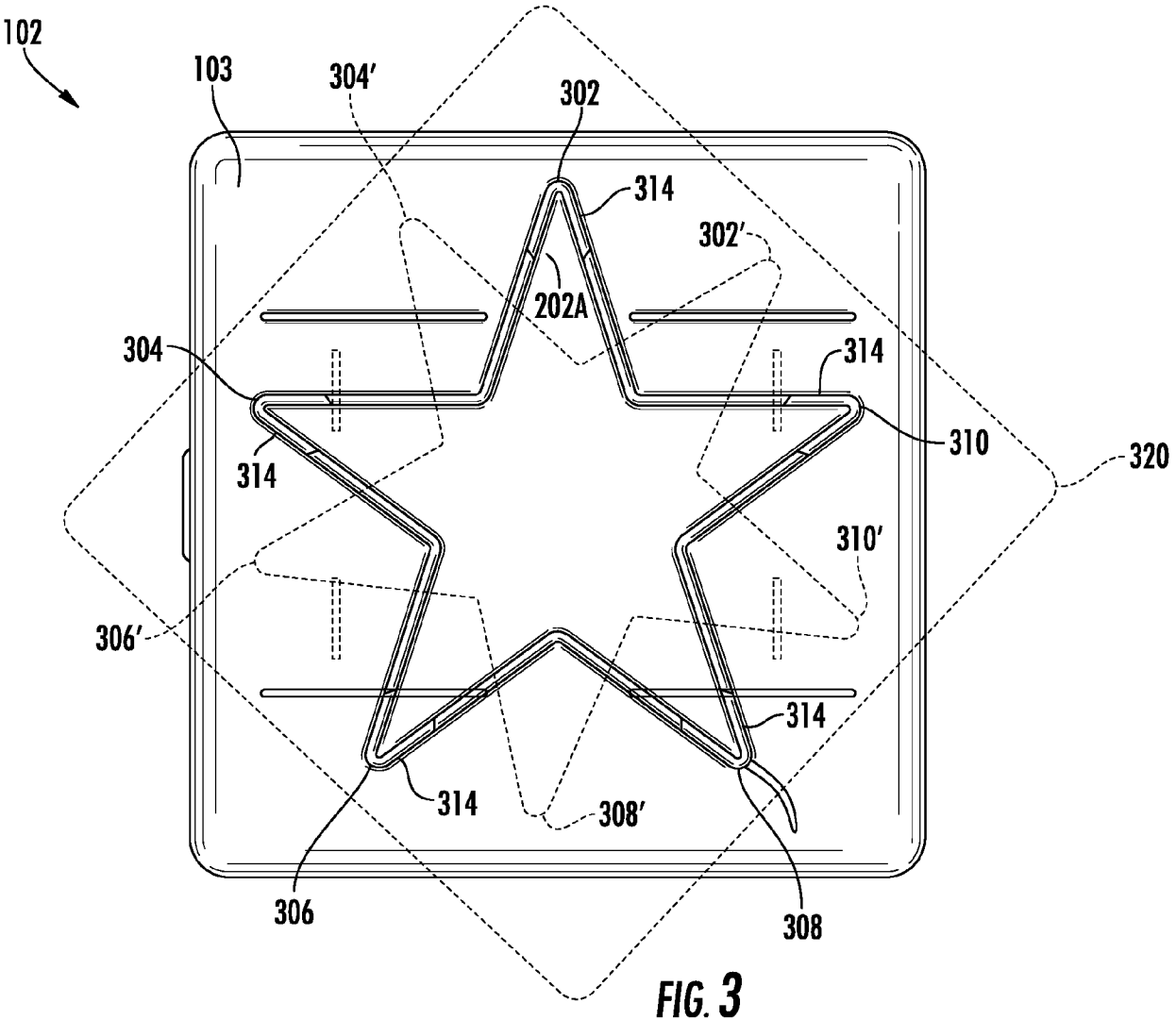
FIG. 3 is a plan view of the lid of the container as superimposed on a bottom panel of the container, an angularly displaced position of the lid being shown in phantom.

The star 106 of the illustrated embodiment shown in FIGS. 1-3 has five substantially congruent vertices or star points 302, 304, 306, 308, 310. The substantial congruence of the vertices 302, 304, 306, 308, 310 ensures that the "V's" 202 of the cooperating engagement surface and the points of the star 302, 304, 306, 308, 310, nest or mate with each other in any of many positions. The nesting "V's" are protuberances which are radially displaced from the axis. While the star has five substantially congruent vertices in the illustrated embodiment in FIG. 3, the star may have as few as three vertices or as many as can be accommodated on the bottom panel 114 or top panel 103. The vertices of the star, 302, 304, 306, 308, 310 are recesses which are also radially displaced from the axis. In all instances the number of "V's" or protuberances should be an integral multiple of the number of star vertices or recesses.

Figure 3A:
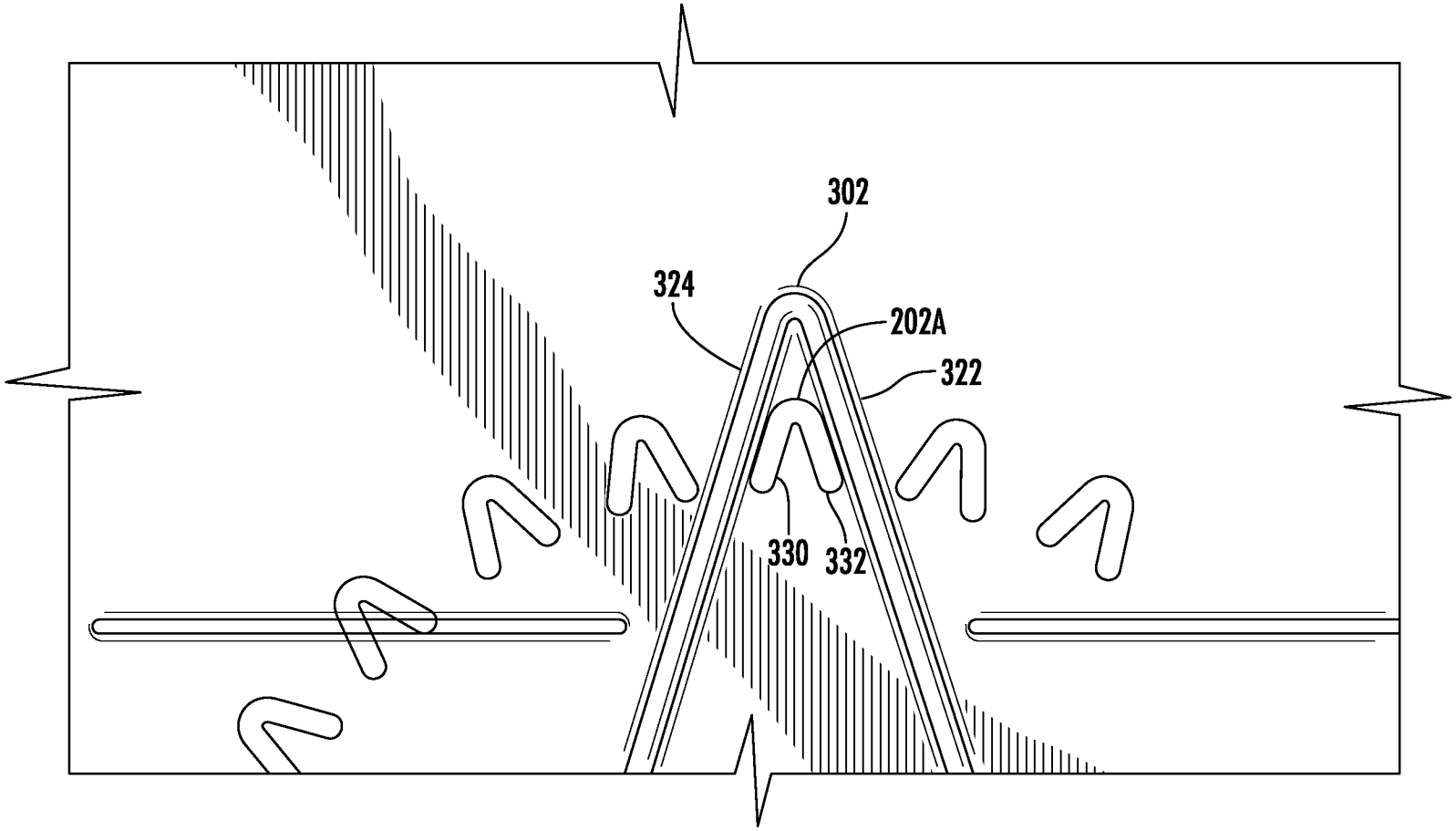
FIG. 3A is a detail view of the lid of the container of FIG. 3.

As illustrated in FIG. 3A, each "V" 202 has sides 330, 332 with angles less than or equal to the angle of the star points 302, 304, 306, 308, 310 and nests radially inwardly from the preselected star point. For example, as shown in FIGS. 3 and 3A, engagement member 202A is fully nested in star point 302. The legs 330, 332 of the "V" 202A are adjacent to respective ones of the ribs 322, 324 of the star 106 which will prevent movement and sliding. With five nested engagement members, rotational movement between the cooperating engagement surfaces is prevented.

In the embodiment illustrated by FIGS. 1-3, one set of engagement members 202 on bottom panel 114 is in angular alignment with respective vertices 302-310 of the star 106 on the top panel 103. There are four other sets of engagement members 202, each set being equal in number to the number of vertices in the star 106, with the engagement members 202 in each set being a predetermined angle away from the nearest vertex 302-310. The predetermined angle of offset of each set is different from the others.

FIG. 3 also shows a second container 320 in phantom achieving a second engagement position which is angularly offset from the first engagement position. To achieve the second position 320 the star of container 100 cooperates with a second set of "V's" 202 on a second container 100. The "V's" used to achieve the second position 320 are at a different angle of offset than the engagement members 202 used to achieve the first engagement position. As shown in FIG. 3, to achieve the second engagement position, the star point 302 is rotated from its original position to the position shown by 302'. Likewise star points 304, 306, 308, and 310 are rotated to positions 304', 306', 308' and 310' respectively. The second engagement position 320 is displaced from the original position by an angle which is greater than zero but less than ninety degrees; in the embodiment illustrated in FIG. 3, the angular displacement is 43.2 degrees.

As shown in the illustrated embodiment in FIG. 3, the lid 102 has fins 314 disposed on the interior of the top panel 103. The fins 314 preferably have varied orientations to aid in product placement and display. Particularly where lid 102 or container 100 is chosen to be transparent, it is preferred that fins 314 line up with the engagement surface walls on the reverse face of panel 103, to render the contents more visible.

Figure 4:
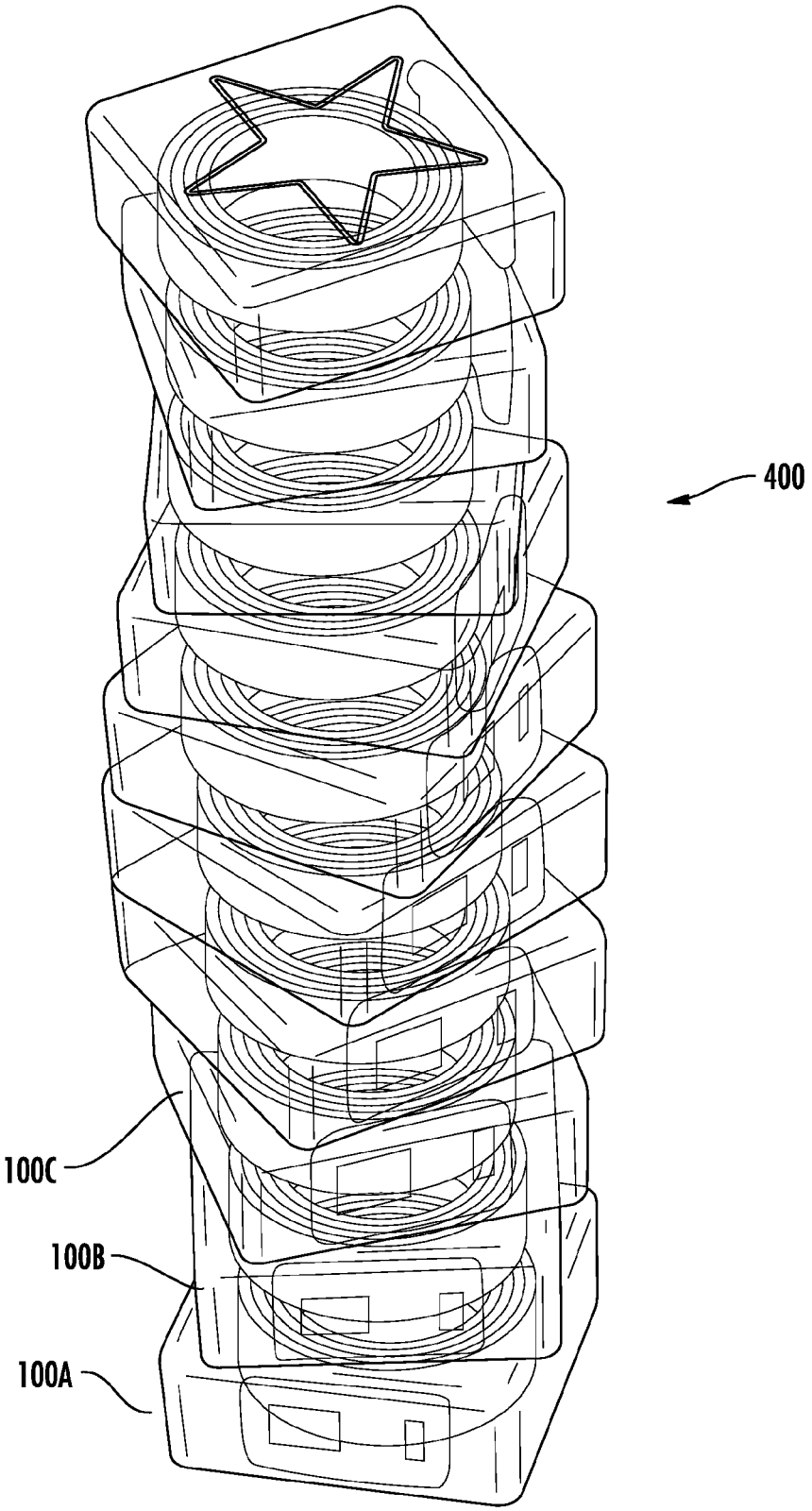
FIG. 4 is an isometric view of a helical stack of containers, the container being chosen to be made of a transparent material and containing a product.

FIG. 4 shows multiple containers stacked in a helical stack configuration 400. A first container 100A forms the base of the stack. The first container 100A is placed on a floor, shelf or other preferred display or stacking surface. The second container 100B is placed on the first container 100A, with the axis X of the second container 100B in substantial alignment with the axis X of the first container 100A, the axis X then forming the axis of a helix. The second container 100B is placed in a position that is rotated 14.4 degrees from the first container as measured around the axis X. The star on the top panel of the first container registers with the "V's" on the exterior of the bottom panel of the second container. A third container 100 is placed in a position where the angle of rotation around the axis X between the second container 100 and third container 100 is 14.4 degrees. The star of the top panel of the second container registers with the "V's" of the third container. The stacking and positioning may be continued until the desired stack height is achieved.

FIG. 4 illustrates a helical stack in which the first engagement surface is a regular five-pointed star and the second engagement surface consists of five sets of "V's" at 14.4 degree offsets from each other. The amount of helical twist may be varied by choosing stars or other engagement surface with more or fewer identical radial sectors, and/or by varying the number of second engagement surface members adapted to receive them, and/or choosing to shift by more than one angular position.

While the angular rotation around the axis X is shown as a constant 14.4 degrees in FIG. 4, the angular rotation may be any measurement greater than zero degrees and less than 90 degrees. Furthermore, the angular rotation in a stack does not have to remain constant. For example, for the embodiment illustrated in FIG. 4, the angular rotation between any two consecutive containers may vary between 14.4 degrees and 86.4 degrees in increments of 14.4 degrees. In addition, the containers may alternate between two positions which would then not form a helical stack but will form a stack of alternately angularly displaced containers.

In the embodiment illustrated in FIG. 1, the bottom panel 114 of the container 100 is square and the container body 104 has four panels 107, 108, 110, 112. However, the container 100 and the bottom panel 114 can be formed in other non-circular cylindrical shapes. For example the bottom panel 114 can be triangular, hexangular or octagonal. The number of container body panels would correspond to the number of sides of the bottom panel 114. If the container body is a cylindrical or curvilinear shape, there may be only one body panel. However, in most instances, the top panel 103 would mimic the approximate shape of the bottom panel 114.

In the illustrated embodiment in FIG. 1, the top panel 103 is a portion of a lid 102. However, the top panel 103 does not have to be a lid and may instead be a fixed portion of the container. In the embodiment illustrated in FIG. 1, the lid 102 is fully detachable from the container body 104. In alternative embodiments, the lid 102 may be hinged, may slide in a groove or may be otherwise partially attached to the container body or joined to it in other ways. Ingress to the container may instead be made through one or more side panels.

In the illustrated embodiment shown in FIGS. 1 to 4, the cooperating engagement surfaces are shown as a five pointed star and a plurality of "V's." In the illustrated embodiment the star-shaped engagement surface is formed with raised ribs with a hollow interior. Alternatively, the entire star-shaped engagement surface, as well as any other engagement surface, could be a raised surface or eminence, a depression or a slot or even an opening in the respective panel. Alternatively, the cooperating engagement surface could be any cooperating engagement surface that prevents circular rotation between two containers and provides for a second container to be placed in a position such that the angular rotation around the axis is measured between zero and ninety degrees exclusive, including engagement surfaces that are formed as a raised rib, raised surface, an indented surface or a slot or opening in the respective panel.

The minimum structure required for the cooperating engagement surfaces is the structure necessary to prohibit circular rotation between the cooperating engagement surfaces and provide for at least two positions such that the angular rotation between them around the axis is measured between zero and ninety degrees. Preferably the minimum structure will include structure for one position for one engagement surface and structure for two positions for the cooperating engagement surface with the two positions angularly offset from each other. Alternatively, the engagement surfaces may be chosen and positioned on the respective panels such that only one cooperating position is achievable. In such an embodiment, the first engagement surface is positioned on its respective panel such that when the second container is stacked onto the first container, the second engagement surface only cooperates with the first engagement surface of the first container when the front panel 107 of the second container is angularly offset from the front panel 107 of the first container.

In a further embodiment of the invention, one of the engagement surfaces could be a polygon with congruent vertices such as a star, square, hexagon or an octagon. The cooperating surface for a polygon-shaped engagement surface would be any cooperating engagement surface that prevents circular rotation between two containers and provides for a second container to be placed in a position such that the angular rotation around the axis is measured between zero and ninety degrees.

Figure 5:
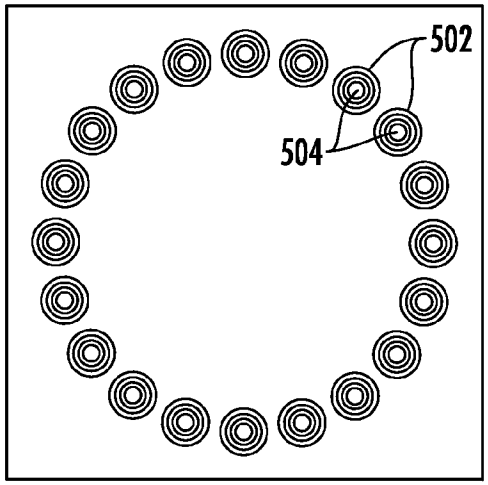
FIG. 5 is a plan view of a second embodiment of the invention, showing circular walls of a first engagement surface being in registration with circular walls of a second engagement surface.
Figure 5A:
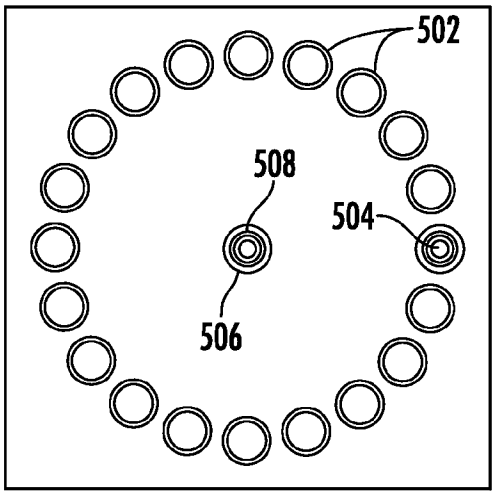
FIG. 5A is a plan view of a third embodiment of the invention, showing circular walls of a first engagement surface being in registration with two circular walls of a second engagement surface.

In yet a further embodiment of the invention, one of the engagement surfaces may include more than two horizontally spaced-apart features. The spaced-apart features may include a series of raised rib circles 502 placed around the center of the container bottom panel or top panel as shown in FIG. 5. The raised rib circles 502 are disposed at a constant radius from the center. The cooperating engagement surface may be a series of nesting circles 504 as shown in FIG. 5. Alternatively, the engagement surface may include the series of raised rib circles 502 with an additional raised rib circle 506 or other engagement member, placed on the center of the engagement surface as shown in FIG. 5A. The cooperating engagement surface may include one nesting circle 508 aligning with the center circle 506 and one nesting circle on the outer circumference of circles 504 as illustrated in FIG. 5A.

Figure 7:
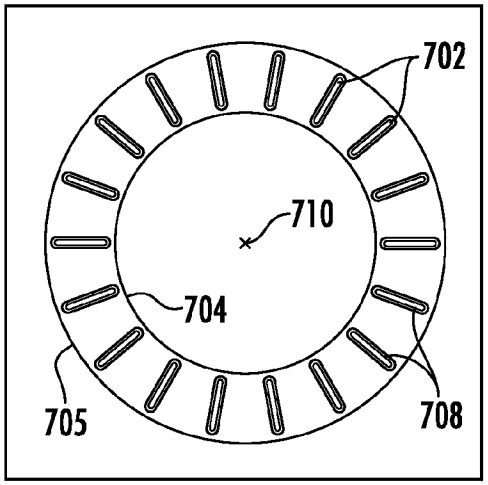
FIG. 7 is a plan view of a sixth embodiment of the invention, showing ovoid walls of a first engagement surface and short raised walls of a second engagement surface.
Figure 7A:
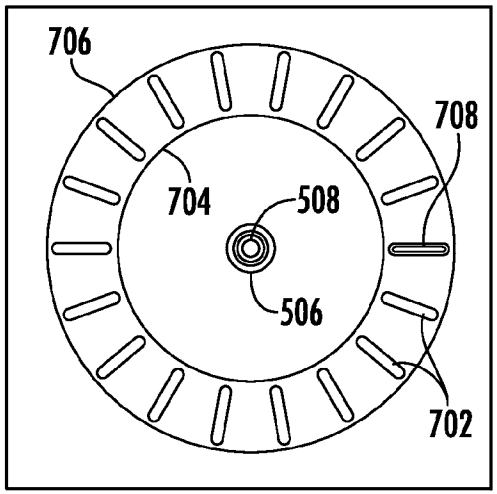
FIG. 7A is a plan view of a seventh embodiment of the invention, showing ovoid walls and a circular wall of a first engagement surface and a short raised wall and circular wall of a second engagement surface.

The spaced apart features may also include a series of ovoids 702 as shown in FIG. 7. The ovoids 702 extend radially outwardly between the circumference of an inner circle 704 and the circumference of an outer circle 706, both of which are centered on the center 710 of either the bottom panel 114 or top panel of the lid 103. The cooperating engagement surface may be a series of nesting rods 708 as shown in FIG. 7. Alternatively, the engagement surface may include the ovoids 702 with an additional raised rib circle 506, or other engagement member, placed on the center of the engagement surface. The cooperating engagement surface may then include one nesting circle 508 aligning with the center circle 506 and a second engagement member in the shape of a nesting rod 708 as shown in FIG. 7A. Alternatively variations of the illustrated embodiment may include any combination of cooperating engagement surfaces that prevent circular rotation between two containers and provide for a second container to be placed in a position such that the angular rotation around the axis measures greater than zero degrees and less than ninety degrees.

Figure 6:
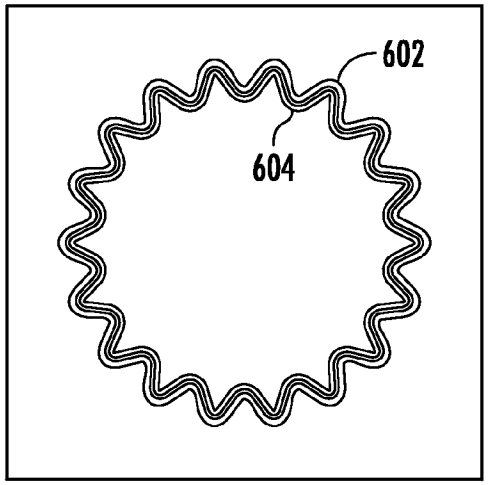
FIG. 6 is a plan view of a fourth embodiment of the invention, showing a curvilinear wall of a first engagement surface being in registration with curvilinear walls of a second engagement surface.
Figure 6A:
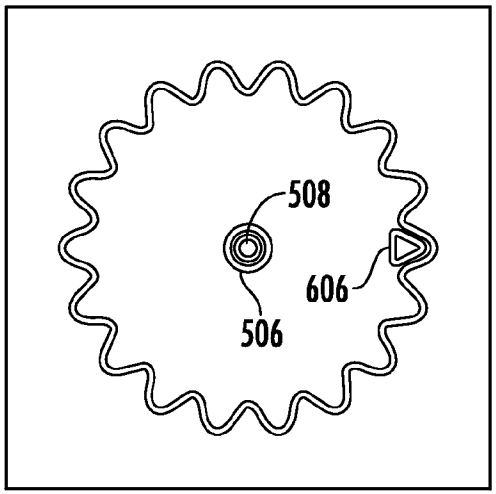
FIG. 6A is a plan view of a fifth embodiment of the invention, showing a curvilinear wall and a center circular wall of a first engagement surface being in registration with an engagement member and circular wall of a second engagement surface.

FIG. 6 illustrates a further embodiment of the invention where one of the engagement surfaces is an undulating curvilinear shape 602 placed around the center of the container bottom panel or top panel. The curvilinear shape 602 does not have straight lines or vertices, but is a regularly repeating shape composed of curve segments. Importantly, the curvilinear shape 602 is capable of being divided into repeatable identical sectors where each sector is a portion of the curvilinear shape 602 bounded by two radii. The repeatable identical sectors allow for a cooperating engagement surface and multiple container positions. The cooperating engagement surface may be a nesting curvilinear shape 604. Alternatively, the engagement surface may include a curvilinear shape 602 with an additional raised rib circle 506, or other engagement member, placed on the center of the engagement surface. The cooperating engagement surface may then include one nesting circle 508 aligning with the center circle 506 and a second engagement member 606 along the circumference of the curvilinear shape 602 as illustrated in FIG. 6A. Variations of the illustrated embodiment may include any combination of cooperating engagement surfaces that prevent circular rotation between two containers and provide for a second container to be placed in a position such that the angular rotation around the axis measures greater than zero degrees and less than ninety degrees.

Figure 8:
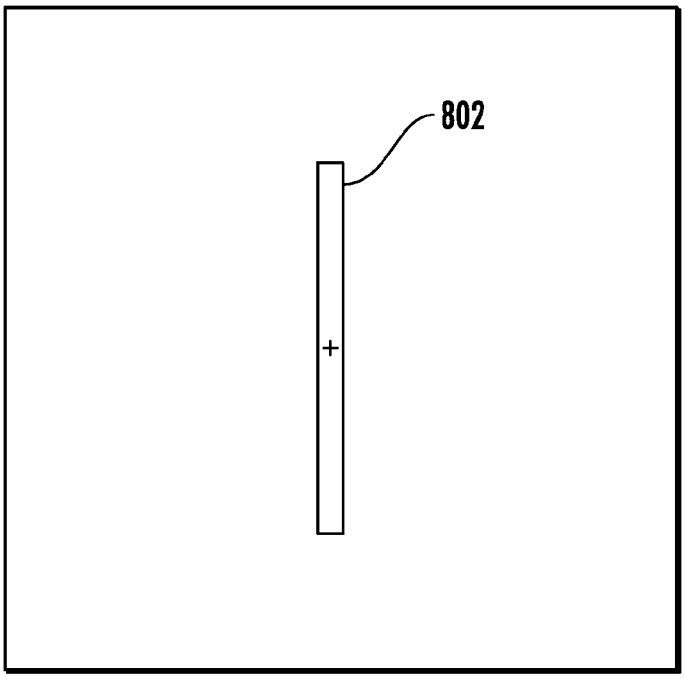
FIG. 8 is a plan view of one engagement surface of an eighth embodiment of the invention, showing a continuous raised wall of a first engagement surface.
Figure 9:
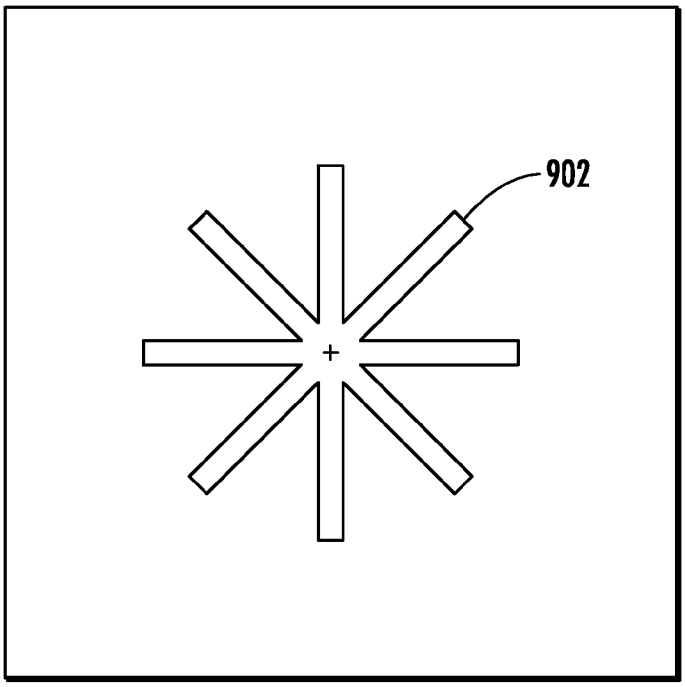
FIG. 9 is a plan view of a second engagement surface of the eighth embodiment of the invention, showing a slot.

As shown in FIG. 8, in an alternate embodiment one of the engagement surfaces may be a rod 802 or mesa. As illustrated, the rod 802 or mesa may be continuous and extend through the center of the respective panel. The cooperating second engagement surface for the rod may be may be intersecting slots 902, as shown in FIG. 9 into one of which the rod 802 is fit.

Alternatively one of the engagement surfaces could be one or more eminences or protuberances as shown in FIG. 8. The cooperating engagement surface for an eminence could include one or more depressions that would be sized and oriented to receive the eminence as shown in FIG. 9. The cooperating engagement surfaces would prevent circular rotation between two containers and provide for a second container to be placed in a position such that the angular rotation around the axis is measured between zero and ninety degrees.

Figure 10:
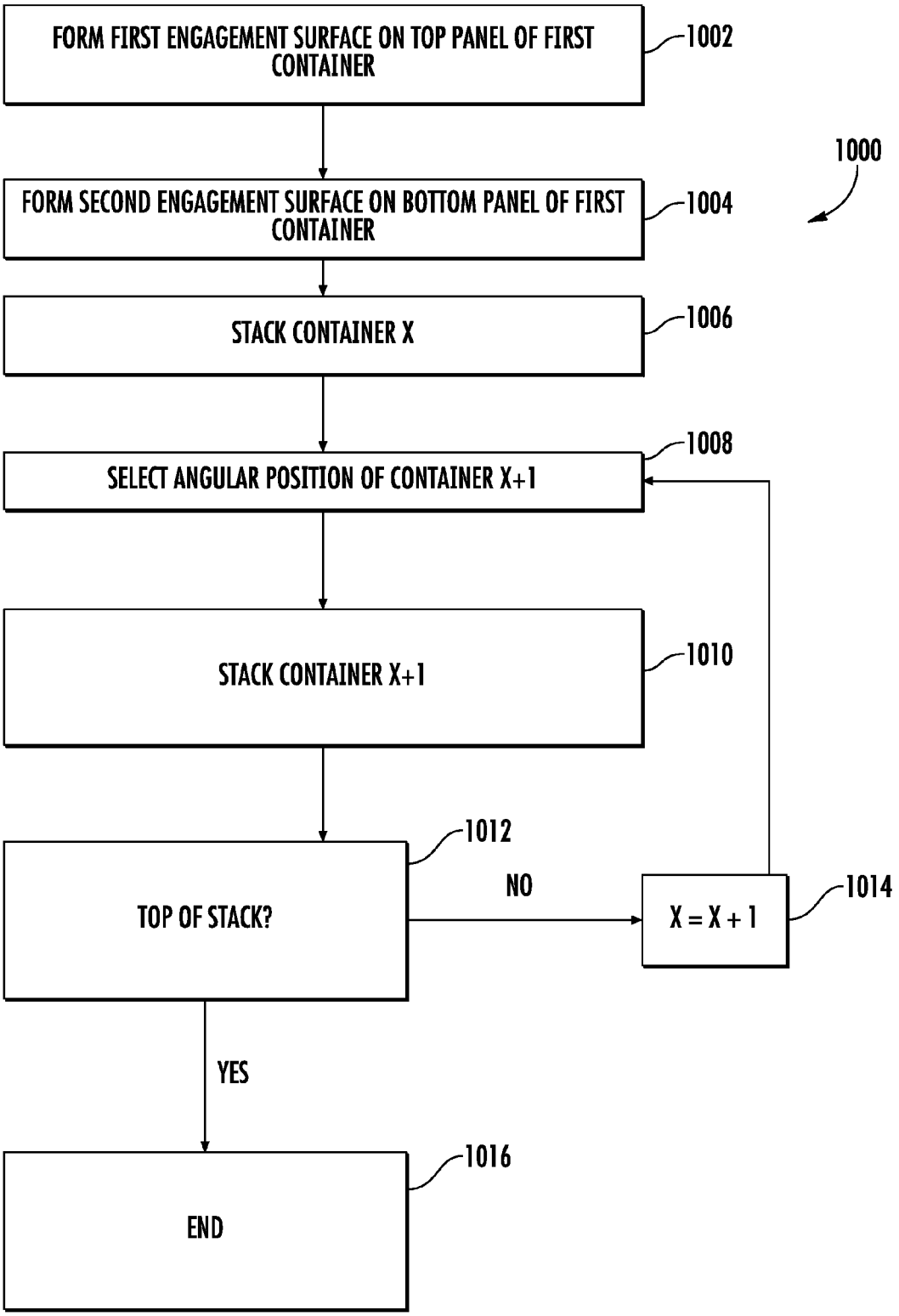
FIG. 10 is a schematic block diagram showing steps for a method stacking containers according to the invention.

FIG. 10 illustrates a further aspect of the invention, in which a method 1000 for positioning multiple containers in a helical stack is accomplished by forming 1002 a first engagement surface on the top panel of a first container and a cooperating engagement surface on the bottom panel of a second container 1004. The first container is stacked 1006 and an angular position for the second container is chosen 1008 where the displacement being greater than zero but less than ninety degrees. The second container is then stacked 1010 on the first container. If the top of the stack has been achieved 1012, the stacking ends 1016 at this point. If, however, the top of the stack has not been achieved 1012, the next container is determined 1014. The angular position of the consecutive container is determined 1008 and the container is stacked 1010. The stacking continues until the helical stack reaches its desired height 1016.

In summary, containers have been shown and described which have top and bottom engagement surfaces that permit their assembly into a helical stack. While illustrated embodiments of the present invention have been described and illustrated in the appended drawings, the present invention is not limited thereto but only by the scope and spirit of the appended claims.

We claim:

1. A container for use in creating a display stack comprising a plurality of such containers, the container comprising:

a container body having a bottom panel with an exterior surface, the container body disposed around a vertical axis, a general exterior surface of the bottom panel being substantially perpendicular to the axis, a first engagement surface formed on the general exterior surface;

a top panel of the container body axially spaced from and opposed to the bottom panel, the top panel disposed around the axis and having a general exterior surface which is substantially perpendicular to the axis, a second engagement surface formed on the top panel;

the container being axially stackable on a second, similar container in either of at least first, second and third positions, the first, second and third positions being displaced from each other by an angle which is greater than zero but less than ninety degrees, the first engagement surface of the container cooperating with the second engagement surface of the second container to prevent axial rotation of the container relative to the second container when the container is in the first, second or third positions; and, wherein a preselected one of the first and second engagement surfaces is a raised rib star with a plurality of star points, the other of the first and second engagement surfaces including a plurality of raised rib "V's" having sides with angles less than or equal to the angle of the star points and radially inwardly displaced from a locus of the star points so that each "V" is adapted to fit inside a selected star point.

2. The container of claim 1, wherein the top panel forms at least a portion of a lid for the container.

3. The container of claim 1, wherein a third container similar to the first and second containers is axially stackable on the second container in any of at least a fourth, fifth and sixth positions, the fourth, fifth and sixth positions being displaced from each other relative to the axis by an angle which is greater than zero but less than ninety degrees, the first engagement surface of the second container cooperating with the second engagement surface of the third container to prevent axial rotation of the second container relative to the third container when the third container is in any of the fourth, fifth and sixth positions.

4. The container of claim 3, wherein the containers are stackable such that the angular position of any container is angularly displaced from a next adjacent container by a constant amount.

5. The container of claim 1, wherein the number of raised rib "V's" is equal to a multiple of the number of star points.

6. The container of claim 1, wherein at least one of the first and second engagement surfaces is formed by an elongate endless wall.

7. The container of claim 1, wherein the general exterior surface of the bottom panel has a plurality of feet which extend downwardly therefrom and which are laterally spaced from each other and the first engagement surface, a height of the feet as measured from the general exterior surface being greater than a height of the first engagement surface as measured from the general exterior surface of the bottom panel and further being greater than a height of the second engagement surface as measured from the general exterior surface of the top panel.

8. A container capable of being stacked in a helical stack of like containers, comprising:

a body having a bottom panel which is substantially perpendicular to a helical stacking axis and further having a top panel axially displaced from the bottom panel, the top panel also being substantially perpendicular to the axis;

a first engagement surface formed on a first of the top and bottom panels, the first engagement surface having a plurality of recesses equally horizontally displaced from the axis and each extending in a radial direction, the recesses being equally angularly spaced apart from each other;

a second engagement surface formed on the other of the top and bottom panels, the second engagement surface having a plurality of protuberances which are an integral multiple of the number of recesses, the protuberances being equally horizontally displaced from the axis, the protuberances being equally angularly spaced apart from each other;

the protuberances being organized into sets equal in number to said integral multiple, the protuberances in any set being spaced apart in angular position by protuberances in the other sets, at least one set of protuberances being angularly displaced relative to the angular position of the recesses by a predetermined angle which is chosen to be greater than zero but less than ninety degrees;

wherein the angle between adjacent ones of the recesses is 72 degrees.

9. A container capable of being stacked in a helical stack of like containers, comprising:

a body having a bottom panel which is substantially perpendicular to a helical stacking axis and further having a top panel axially displaced from the bottom panel, the top panel also being substantially perpendicular to the axis;

a first engagement surface formed on a first of the top and bottom panels, the first engagement surface having a plurality of recesses equally horizontally displaced from the axis and each extending in a radial direction, the recesses being equally angularly spaced apart from each other;

a second engagement surface formed on the other of the top and bottom panels, the second engagement surface having a plurality of protuberances which are an integral multiple of the number of recesses, the protuberances being equally horizontally displaced from the axis, the protuberances being equally angularly spaced apart from each other;

the protuberances being organized into sets equal in number to said integral multiple, the protuberances in any set being spaced apart in angular position by protuberances in the other sets, at least one set of protuberances being angularly displaced relative to the angular position of the recesses by a predetermined angle which is chosen to be greater than zero but less than ninety degrees;

wherein the recesses are disposed on the top panel and the protuberances are disposed on the bottom panel.

10. A container capable of being stacked in a helical stack of like containers, comprising:

a body having a bottom panel which is substantially perpendicular to a helical stacking axis and further having a top panel axially displaced from the bottom panel, the top panel also being substantially perpendicular to the axis;

a first engagement surface formed on a first of the top and bottom panels, the first engagement surface having a plurality of recesses equally horizontally displaced from the axis and each extending in a radial direction, the recesses being equally angularly spaced apart from each other;

a second engagement surface formed on the other of the top and bottom panels, the second engagement surface having a plurality of protuberances which are an integral multiple of the number of recesses, the protuberances being equally horizontally displaced from the axis, the protuberances being equally angularly spaced apart from each other;

the protuberances being organized into sets equal in number to said integral multiple, the protuberances in any set being spaced apart in angular position by protuberances in the other sets, at least one set of protuberances being angularly displaced relative to the angular position of the recesses by a predetermined angle which is chosen to be greater than zero but less than ninety degrees;

wherein the protuberances project radially outwardly from the first engagement surface and the recesses are displaced from the axis by a distance greater than the protuberances.

11. A container capable of being stacked in a helical stack of like containers, comprising:

a body having a bottom panel which is substantially perpendicular to a helical stacking axis and further having a top panel axially displaced from the bottom panel, the top panel also being substantially perpendicular to the axis;

a first engagement surface formed on a first of the top and bottom panels, the first engagement surface having a plurality of recesses equally horizontally displaced from the axis and each extending in a radial direction, the recesses being equally angularly spaced apart from each other;

a second engagement surface formed on the other of the top and bottom panels, the second engagement surface having a plurality of protuberances which are an integral multiple of the number of recesses, the protuberances being equally horizontally displaced from the axis, the protuberances being equally angularly spaced apart from each other;

the protuberances being organized into sets equal in number to said integral multiple, the protuberances in any set being spaced apart in angular position by protuberances in the other sets, at least one set of protuberances being angularly displaced relative to the angular position of the recesses by a predetermined angle which is chosen to be greater than zero but less than ninety degrees;

wherein the recesses are inner vertices of a hollow star formed by at least one wall.

* * * * *